US008177608B2

(12) United States Patent
Schmied et al.

(10) Patent No.: US 8,177,608 B2
(45) Date of Patent: May 15, 2012

(54) FAN-TYPE GRINDING WHEEL

(75) Inventors: Vadim Schmied, Marienheide (DE); Hermann Hardenbicker, Wipperfürth (DE)

(73) Assignee: August Rueggeberg GmbH & Co. KG, Marienheide (DE)

( * ) Notice: Subject to any disclaimer, the term of this patent is extended or adjusted under 35 U.S.C. 154(b) by 417 days.

(21) Appl. No.: 12/476,505

(22) Filed: Jun. 2, 2009

(65) Prior Publication Data

US 2009/0305619 A1 Dec. 10, 2009

(30) Foreign Application Priority Data

Jun. 4, 2008 (DE) ..... 10 2008 026 722

(51) Int. Cl.
*B24D 9/04* (2006.01)
*B24D 13/06* (2006.01)

(52) U.S. Cl. ..... 451/466; 451/468; 451/358

(58) Field of Classification Search ..... 451/464–466, 451/468, 469, 486, 358, 490, 510
See application file for complete search history.

(56) References Cited

U.S. PATENT DOCUMENTS

| | | | | |
|---|---|---|---|---|
| 1,377,598 | A * | 5/1921 | Paoli | 451/469 |
| 2,804,731 | A | 9/1957 | Bernstein et al. | |
| 4,835,912 | A * | 6/1989 | Block | 451/465 |
| 5,722,881 | A | 3/1998 | Emerson | |
| 2005/0000166 | A1 | 1/2005 | Muller | |

FOREIGN PATENT DOCUMENTS

| | | |
|---|---|---|
| EP | 1266724 A1 | 12/2002 |
| EP | 1543923 A1 | 6/2005 |
| FR | 2731936 A1 | 9/1996 |

* cited by examiner

*Primary Examiner* — Dung Van Nguyen
(74) *Attorney, Agent, or Firm* — Browdy and Neimark, PLLC

(57) ABSTRACT

A fan-type grinding wheel comprises a rigid support plate and is provided with grinding elements. These grinding elements comprise a main portion forming a first working face and a bending portion forming a peripheral working face. Furthermore, they comprise an outer portion forming a second working face.

16 Claims, 4 Drawing Sheets

FAN-TYPE GRINDING WHEEL

BACKGROUND OF THE INVENTION

1. Field of the Invention

The invention relates to a fan-type grinding wheel which is drivable in a direction of rotation, the fan-type grinding wheel comprising a support plate which comprises
- a central axis;
- an inner hub; and
- an annular rim region with an outer peripheral rim; and grinding elements which
- are fastened on the rim region so as to form an annular grinding element package; and
- encompass the peripheral rim.

2. Background Art

A fan-type grinding wheel of this type is known from U.S. Pat. No. 2,804,731 A. The grinding elements are rectangular in shape and are in each case disposed around the outer peripheral rim of the rim region, with a filling material being applied on both sides of the support plate consisting of cardboard so that the segments are disposed around the outer periphery of the support plate approximately in the shape of three quarters of a circle when seen in cross-section. The ends of the grinding elements facing the central axis are clamped on both sides of the support plate by means of in each case one flange and are centrally clamped and held in place by means of a threaded pin and a nut. The sole object of this embodiment is to ensure a simple peripheral grinding or polishing.

A similar fan-type grinding wheel is known from FR 2 731 936 A1 where the grinding elements are disposed on filling bodies in the outer rim region as well.

SUMMARY OF THE INVENTION

It is the object of the invention to provide a fan-type grinding wheel comprising grinding elements which are bent around the outer peripheral rim of the support plate, the fan-type grinding wheel having a simple and rigid design for all-around use whilst ensuring a high grinding performance.

This object is achieved according to the invention by a fan-type grinding wheel which is drivable for rotation in a direction of input rotation, the fan-type grinding wheel comprising a rigid support plate which comprises
- a central axis;
- an inner hub; and
- an annular rim region with an outer peripheral rim;

grinding elements which comprise
- in each case one main portion;
- a bending portion;
- an outer portion;
- a longitudinal edge which is arranged in a leading manner relative to the direction of input rotation; and
- a longitudinal edge which is arranged in a trailing manner relative to the direction of input rotation;
- whose respective main portions form a first working face in the form of an annular grinding element package on a first side of the support plate, the main portions being fastened at identical angular distances only in the region of their leading longitudinal edge;
- whose respective bending portions are bent around the outer peripheral rim of the rim region in such a way that they have in each case an approximately semi-frustoconical shape and form a peripheral working face; and

- whose respective outer portions are fastened on a second side of the support plate only in the region of their leading longitudinal edge as well, the outer portions thus forming a second working face.

The grinding elements are fastened—if necessary only locally—on the two working faces of the rim region of the support plate only in the region of the leading longitudinal edge; they can therefore easily be arranged such as to overlap or cover each other. The semi-frustoconical shape of the radially outer bending portion allows the overlapping grinding elements to be neatly arranged in a closely adhering manner even in the outer rim region in such a way as to form a peripheral working face. Owing to its design, the fan-type grinding wheel according to the invention is applicable for three-face roughing. This allows the workman to machine the upper side and underside of heavy workpieces without having to rotate the workpieces and without having to change his working position or the position of the hand-held angle grinder used for grinding.

Further advantages, features and details of the invention will become apparent from the description of an embodiment by means of the drawing.

DESCRIPTION OF THE PREFERRED EMBODIMENTS

Figure 1:
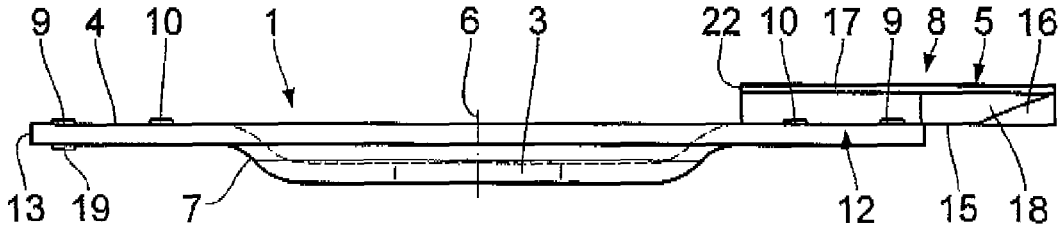
FIG. 1 is a side view of a support plate with only one grinding element being fastened on the working face.
Figure 2:
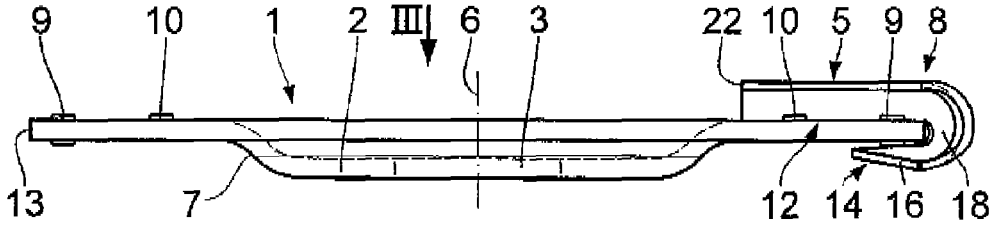
FIG. 2 is a side view of the support plate of FIG. 1 with a fully fastened grinding element according to arrow II in FIG. 3.

As can be seen from FIGS. 1 to 5, a fan-type grinding wheel—also referred to as flap disc—comprises a support plate 1 with a hub 2 which comprises a central circular opening 3. The support plate 1 comprises an outer annular rim region 4 for receiving grinding elements 5 which are also referred to as flaps or abrasive elements. This rim region 4 is connected to the hub 2 by means of an annular web 7 projecting from the hub 2 in the direction of a central axis 6 of the support plate 1. The surface formed by the rim region 4 extends perpendicular to the central axis 6. Due to its design, the support plate 1 is attachable to a drive shaft of a hand-held grinding machine and is fastenable thereto by means of a nut which does not project beyond the rim region 4.

Figure 6:
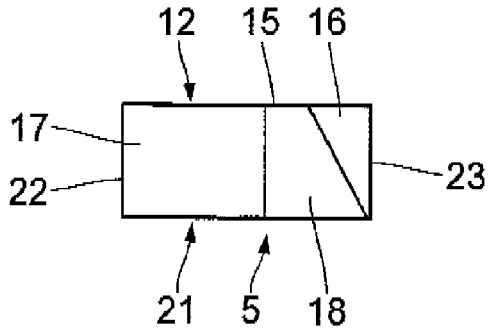
FIG. 6 is a plan view of a grinding element.

The grinding elements 5 usually consist of a grinding material on a carrier. As can be seen in FIG. 6, the individual grinding elements 5 are rectangular in shape. The grinding elements 5 are fastened on the side of the rim region 4—with the hub 2 being recessed with respect to said rim region 4—by means of two lines 9, 10 of adhesive which are disposed on the rim region 4 in the shape of rings that are concentric to the axis 6; the grinding elements 5 thus form a substantially plane first working face 8 on the front side. Each grinding element 5 is fastened on the lines 9, 10 of adhesive only with its longitudinal edge 12 that is arranged in a leading manner relative to the direction of input rotation 11 of the fan-type grinding wheel. It is therefore not fully in contact with the lines 9, 10 of adhesive but projects from the rim region 4 in an obliquely upward direction opposite to the direction of rotation 11.

As can be seen in FIGS. 1 to 5, each grinding element 5 projects beyond the outer peripheral rim 13 of the rim region 4 and is folded or bent around said peripheral rim 13 in the direction of the side of the rim region 4 facing away from the first working face 8, with the hub 2 projecting relative to said side facing away from the first working face 8, as can be seen in FIGS. 1, 2 and 4, 5. The grinding elements 5 for a second working face 14 which is annular as well and which is approximately arranged parallel to the first working face 8 on the back side thereof.

Each grinding element 5 is bent or folded around in each case a portion of the edge region 15 forming the leading longitudinal edge 12 so that the outer portion 16 of the respective grinding element 5 forming the second working face 14 does not overlap the main portion 17 forming the first working face 8. Due to the described bending process, the trapezoidal bending portion 18 of the respective grinding element 5, which is in each case disposed between the main portion 17 and the outer portion 16, forms an approximately semi-frustoconical portion which, according to FIGS. 4 and 5, expands in the direction opposite to the direction of rotation 11. The respective outer portion 16 is fastened on the rim region 4 of the support plate 1 by means of a line 19 of adhesive as well, with the hub 2 projecting therefrom. The totality of the bent bending portions 18 forms a peripheral working face 20.

Figure 7:
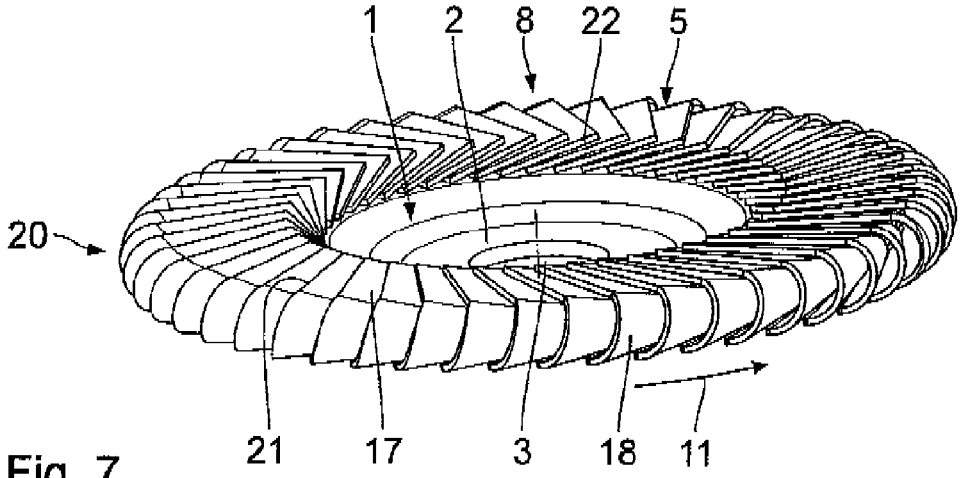
FIG. 7 is a perspective plan view of the working face of a fan-type grinding wheel according to the invention.
Figure 8:
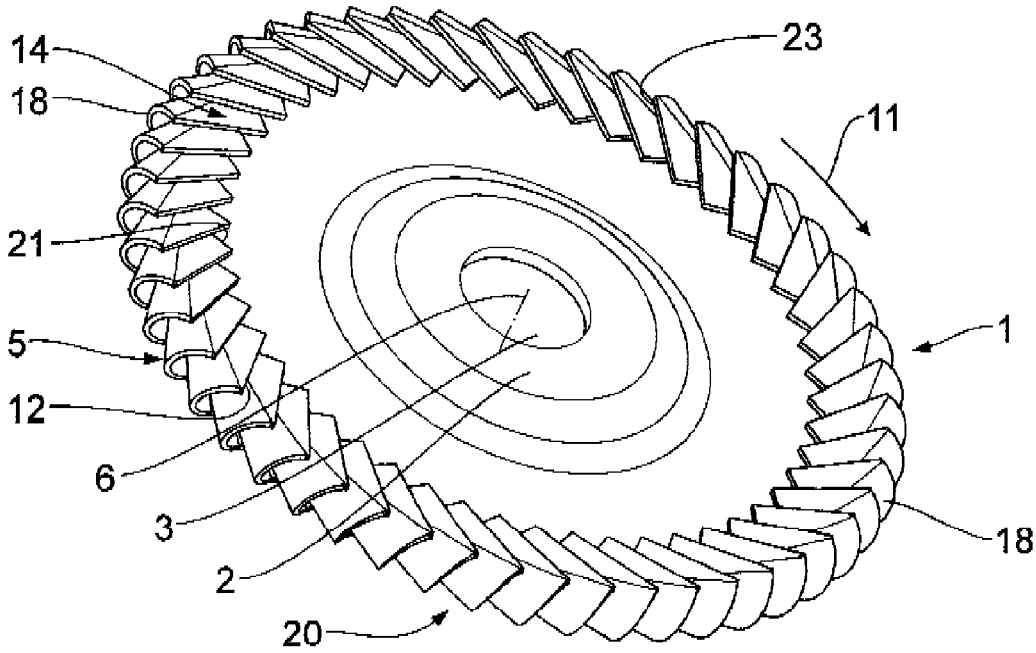
FIG. 8 is a perspective oblique view of the back of the fan-type grinding wheel.

On the finished fan-type grinding wheel, the grinding elements 5 are arranged with a high degree of overlap of 20% to 95%, with only the longitudinal edges 21 of the grinding elements 5 being visible that are arranged in a trailing manner relative to the direction of input rotation 11. The degree of overlap refers to the extent to which a grinding element leading in the direction of rotation overlaps the nearest trailing grinding element in the direction of rotation in relation to its total width. In other words, a degree of overlap of 20% means that the leading grinding element covers only 20% of the width of the trailing grinding element. A low degree of overlap therefore means that only relatively few grinding elements 5 are arranged on a support plate 1 whereas a high degree of overlap means that a very large number of grinding elements 5 are arranged on a support plate 1. Due to the approximately semi-frustoconical shape of the bending portion 18, the outer periphery of the fan-type grinding wheel, in other words the peripheral working face 20, is approximately circular. As can be seen in FIG. 7, the side edges 22 of the grinding elements 5 next to the hub 2 on the first working face 8 combine to form an approximately circular profile. As can be seen in FIG. 8, the side edges 23 to be allocated to the second working face on the other hand form a zig-zag profile with the adjacent regions of the trailing longitudinal edges 21.

Figure 3:
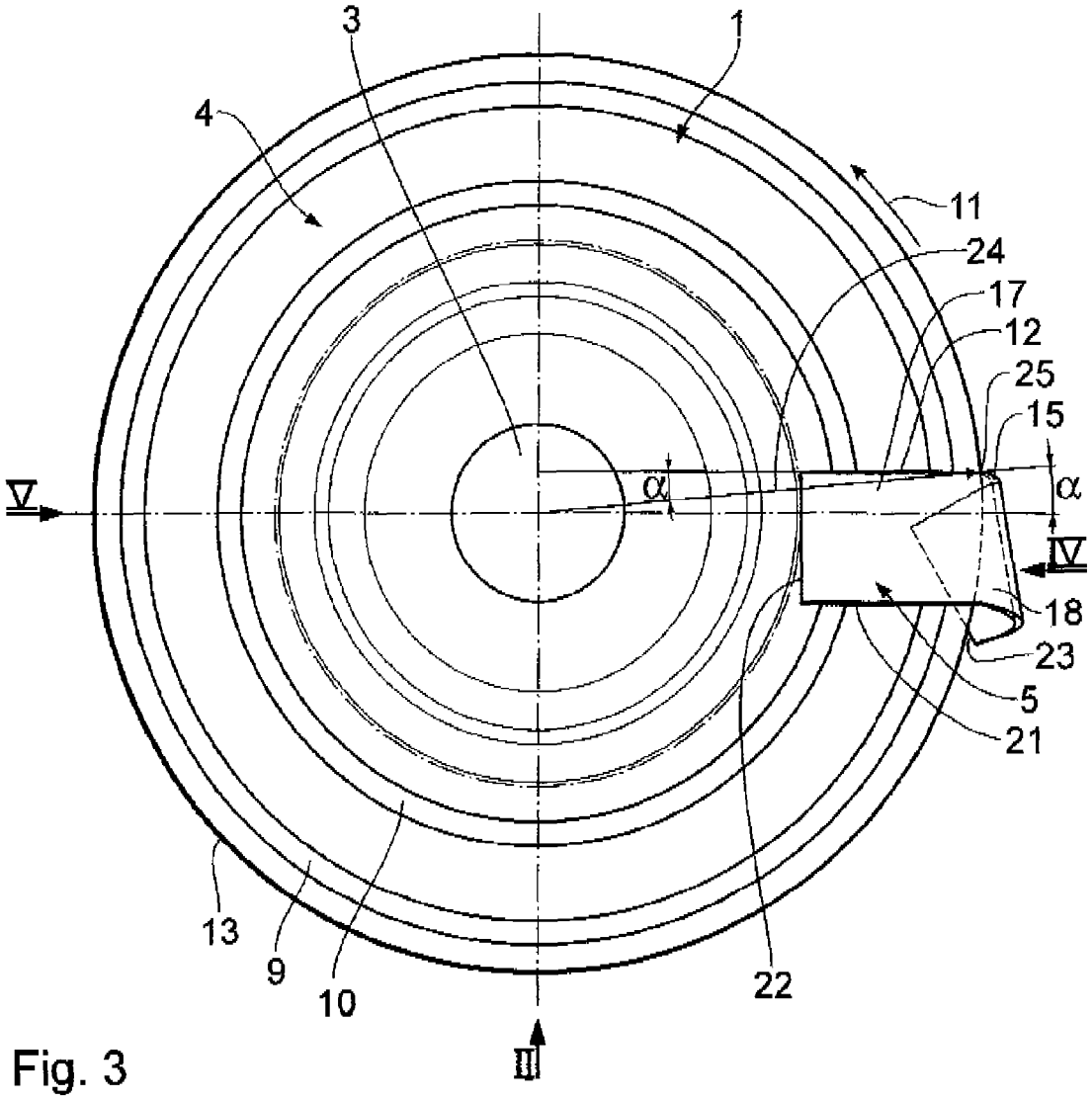
FIG. 3 is a plan view of the support plate of FIG. 2 according to arrow III in FIG. 2.
Figure 4:
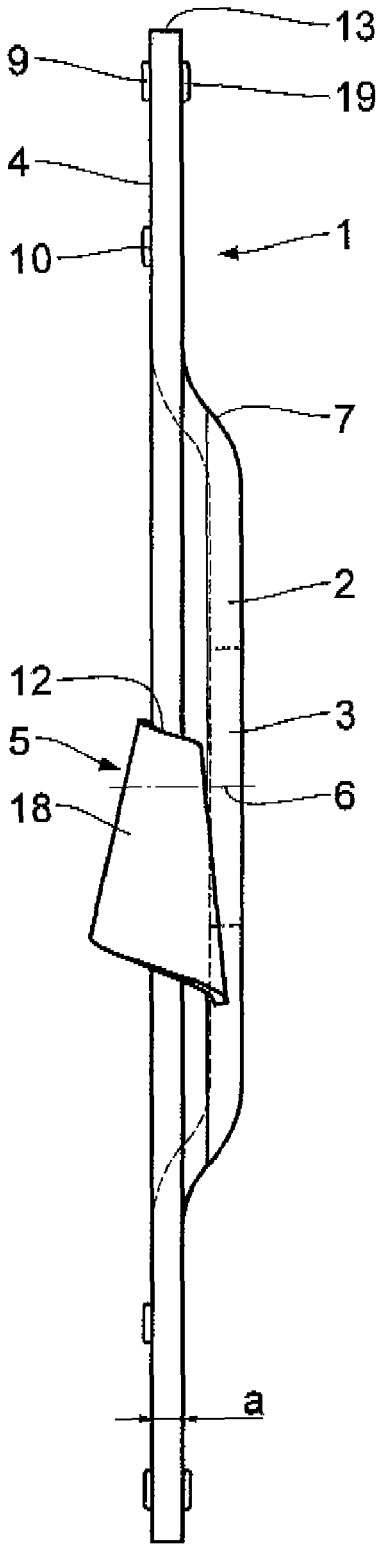
FIG. 4 is a side view of the support plate according to arrow IV in FIG. 3.
Figure 5:
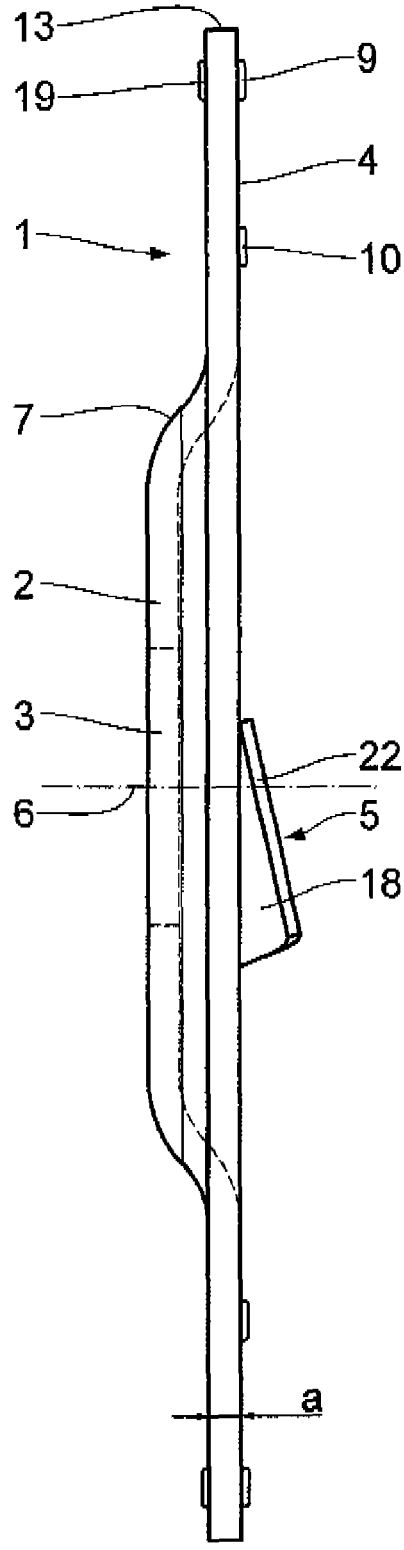
FIG. 5 is a side view of the support plate according to arrow V in FIG. 3.
Figure 9:
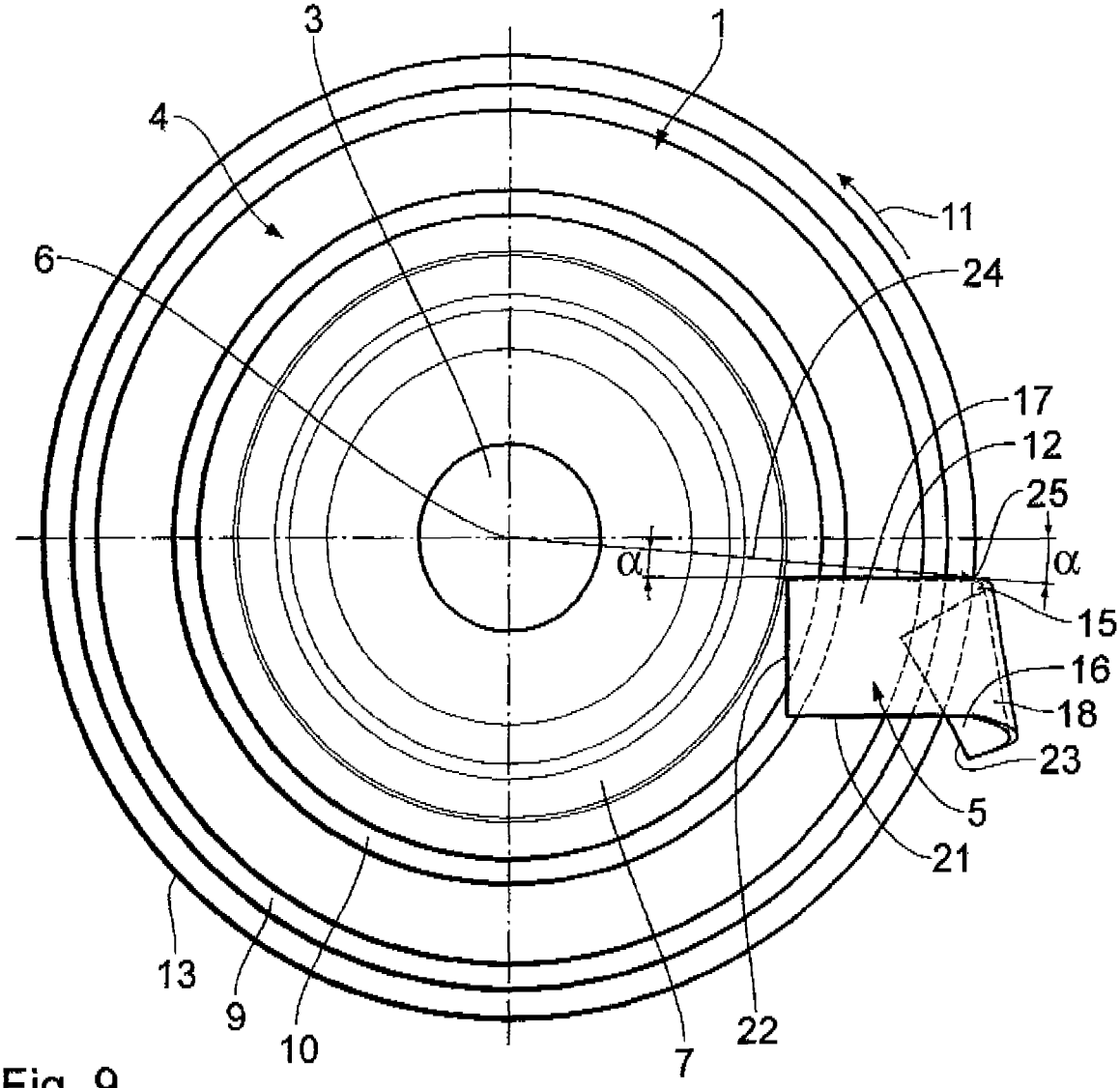
FIG. 9 is a plan view of the support plate according to FIG. 2 with the grinding element being fastened in another way than in FIG. 3.

As can be seen in FIG. 3, the leading longitudinal edge 12 of the main portion 17 of each grinding element 5 is not radial to the central axis 6 but extends at an angle $\alpha$ between a radius 24 and the leading longitudinal edge 12, with their point of intersection 25 being disposed on the peripheral rim 13. If the leading longitudinal edge 12 is arranged in a leading manner relative to the radius 24 in the direction of rotation 11 as can be seen in FIG. 3, the peripheral working face 20 has a very well-defined circular shape. The leading longitudinal edge 12 may however generally be arranged in a trailing manner, relative to the direction of rotation 11, with respect to the radius 24 as well; this is shown in FIG. 9 which substantially corresponds to FIG. 3. If, according to the illustration of FIG. 3, the longitudinal edge 12 is arranged in a leading manner relative to the radius 24, the angle $\alpha$ is referred to as positive; in the case of a trailing arrangement according to FIG. 9, the angle $\alpha$ is referred to as negative. The angle $\alpha$ is such that $+19° \geqq \alpha \geqq -13°$. In the illustration according to FIG. 3, the leading longitudinal edge 12 on the second working face 14 extends from the outside towards the central axis 6 in a strongly tailing manner relative to the direction of input rotation 11 due to the described bending of the bending portion 18 and of the outer portion 16 of the grinding elements 5. This does not apply to the embodiment according to FIG. 9.

As in particular shown by FIGS. 7 and 8, the peripheral working face 20 has a substantially semi-circular cross-section.

The preceding embodiments show that all of the three working faces 8, 14, 20 are applicable for roughing. A fan-type grinding wheel used in a working position of the angle grinder which is equipped with fan-type grinding wheels of this type allows a workman to machine the upper side of a work-piece at first by means of the working face 8 of the fan-type grinding wheel before grinding the underside of the workpiece by means of the second working face 14. The peripheral working face 20 may then be used to machine a possibly existing concave surface of a fillet weld. These applications are particularly advantageous if the workpiece is very heavy and is disposed on a support. It is then not necessary for the workpiece to be rotated during machining as is the case when using conventional fan-type grinding wheels. The possibility of a three-face application of the fan-type grinding wheel naturally implies a sufficiently rigid design of the support plate 1 which allows the support plate 1 to absorb the high loads acting on all sides thereof as a result of the transverse grinding forces. The support plate 1 is therefore provided with a multilayer reinforcement. In present applications, e support plate 1 has a thickness a to which applies: $2.2\ \text{mm} \leqq a \leqq 2.4\ \text{mm}$. The critical factor is the amount of force the support plate 1 needs to absorb in order to withstand the high loads occurring during a three-face roughing operation. It has been found that the support plate 1 needs to absorb a minimum load of 400 N acting thereon without causing damage to the support plate 1, with this load being applied at a radial distance of 10 mm from the peripheral rim 13 of the support plate 1 in a direction parallel to the axis 6. When this load is applied, the support plate 1 is clamped in its opening 3 in the same way as during the operation hereof.

The mentioned hand-held angle grinders which are equipped with the fan-type grinding wheels according to the invention are conventionally used and well-known in practice and are for instance shown and described in EP 1 543 923 A1 to which reference is made.

What is claimed is:

1. A fan-type grinding wheel which is drivable for rotation in a direction of input rotation (11), the fan-type grinding wheel comprising a rigid support plate (1) which comprises a central axis (6);

an inner hub (2); and an annular rim region (4) with an outer peripheral rim (13);

grinding elements (5) which comprise in each case one main portion (17);

a bending portion (18);

an outer portion (16);

a longitudinal edge (12) which is arranged in a leading manner relative to the direction of input rotation (11); and a longitudinal edge (20) which is arranged in a trailing manner relative to the direction of input rotation (11);

whose respective main portions (17) form a first working face (8) in the form of an annular grinding element package on a first side of the support plate (1), the main portions (17) being fastened at identical angular distances in the region of their leading longitudinal edge (12);

whose respective bending portions (18) are bent around the outer peripheral rim (13) of the rim region (4) in such a way that they have in each case an approximately semi-frustoconical shape and form a peripheral working face (20); and whose respective outer portions (16) are fastened on a second side of the support plate (1) in the region of their leading longitudinal edge (12) as well, the outer portions thus forming a second working face (14); and wherein the grinding elements (5) are rectangular in shape.

2. A fan-type grinding wheel according to claim 1, wherein the leading longitudinal edge (12) forms an angle $\alpha$ with a radius (24) of the support plate (1), with a point of intersection (25) being disposed on the peripheral rim of the support plate (1), to which angle $\alpha$ applies: $+19° \geqq \alpha \geqq -13°$, the angle $\alpha$ being positive if the leading longitudinal edge (12) is arranged in a leading manner relative to the direction of rotation (11) and negative if the leading longitudinal edge (12) is arranged in a trailing manner.

3. A fan-type grinding wheel according to claim 1, wherein the peripheral working face (20) has an approximately semicircular cross-section.

4. A fan-type grinding wheel according to claim 1, wherein at least the first working face (8) is substantially plane.

5. A fan-type grinding wheel which is drivable for rotation in a direction of input rotation (11), the fan-type grinding wheel comprising a rigid support plate (1) which comprises a central axis (6);

an inner hub (2); and an annular rim region (4) with an outer peripheral rim (13);

grinding elements (5) which comprise in each case one main portion (17);

a bending portion (18);

an outer portion (16);

a longitudinal edge (12) which is arranged in a leading manner relative to the direction of input rotation (11); and a longitudinal edge (20) which is arranged in a trailing manner relative to the direction of input rotation (11);

whose respective main portions (17) form a first working face (8) in the form of an annular grinding element package on a first side of the support plate (1), the main portions (17) being fastened at identical angular distances only in the region of their leading longitudinal edge (12);

whose respective bending portions (18) are bent around the outer peripheral rim (13) of the rim region (4) in such a way that they have in each case an approximately semi-frustoconical shape and form a peripheral working face (20); and whose respective outer portions (16) are fastened on a second side of the support plate (1) only in the region of their leading longitudinal edge (12) as well, the outer portions thus forming a second working face (14); and wherein the main portions (17) are fastened on the rim region (4) by means of several lines (9, 10) of adhesive.

6. A fan-type grinding wheel according to claim 5, wherein the leading longitudinal edge (12) forms an angle $\alpha$ with a radius (24) of the support plate (1), with a point of intersection (25) being disposed on the peripheral rim of the support plate (1), to which angle $\alpha$ applies: $+19° \geqq \alpha \geqq -13°$, the angle $\alpha$ being positive if the leading longitudinal edge (12) is arranged in a leading manner relative to the direction of rotation (11) and negative if the leading longitudinal edge (12) is arranged in a trailing manner.

7. A fan-type grinding wheel according to claim 5, wherein the peripheral working face (20) has an approximately semicircular cross-section.

8. A fan-type grinding wheel according to claim 5, wherein at least the first working face (8) is substantially plane.

9. A fan-type grinding wheel which is drivable for rotation in a direction of input rotation (11), the fan-type grinding wheel comprising a rigid support plate (1) which comprises a central axis (6);

an inner hub (2); and an annular rim region (4) with an outer peripheral rim (13);

grinding elements (5) which comprise in each case one main portion (17);

a bending portion (18);

an outer portion (16);

a longitudinal edge (12) which is arranged in a leading manner relative to the direction of input rotation (11); and a longitudinal edge (20) which is arranged in a trailing manner relative to the direction of input rotation (11);

whose respective main portions (17) form a first working face (8) in the form of an annular grinding element package on a first side of the support plate (1), the main portions (17) being fastened at identical angular distances only in the region of their leading longitudinal edge (12);

whose respective bending portions (18) are bent around the outer peripheral rim (13) of the rim region (4) in such a way that they have in each case an approximately semi-frustoconical shape and form a peripheral working face (20); and whose respective outer portions (16) are fastened on a second side of the support plate (1) only in the region of their leading longitudinal edge (12) as well, the outer portions thus forming a second working face (14); and wherein the outer portions (16) of the grinding elements (5) are fastened on the rim region (4) by means of at least one line (19) of adhesive.

10. A fan-type grinding wheel according to claim 9, wherein the leading longitudinal edge (12) forms an angle $\alpha$ with a radius (24) of the support plate (1), with a point of intersection (25) being disposed on the peripheral rim of the support plate (1), to which angle $\alpha$ applies: $+19° \geqq \alpha \geqq -13°$, the angle $\alpha$ being positive if the leading longitudinal edge (12) is arranged in a leading manner relative to the direction of rotation (11) and negative if the leading longitudinal edge (12) is arranged in a trailing manner.

11. A fan-type grinding wheel according to claim 9, wherein the peripheral working face (20) has an approximately semicircular cross-section.

12. A fan-type grinding wheel according to claim 9, wherein at least the first working face (8) is substantially plane.

13. A fan-type grinding wheel which is drivable for rotation in a direction of input rotation (11), the fan-type grinding wheel comprising a rigid support plate (1) which comprises a central axis (6);

an inner hub (2); and an annular rim region (4) with an outer peripheral rim (13);

grinding elements (5) which comprise in each case one main portion (17);

a bending portion (18);

an outer portion (16);

a longitudinal edge (12) which is arranged in a leading manner relative to the direction of input rotation (11); and a longitudinal edge (20) which is arranged in a trailing manner relative to the direction of input rotation (11);

whose respective main portions (17) form a first working face (8) in the form of an annular grinding element package on a first side of the support plate (1), the main portions (17) being fastened at identical angular distances only in the region of their leading longitudinal edge (12);

whose respective bending portions (18) are bent around the outer peripheral rim (13) of the rim region (4) in such a way that they have in each case an approximately semi-frustoconical shape and form a peripheral working face (20); and whose respective outer portions (16) are fastened on a second side of the support plate (1) only in the region of their leading longitudinal edge (12) as well, the outer portions thus forming a second working face (14); and wherein the grinding elements (5) are fastened on the support plate (1) with a degree of overlap of 20% to 95%.

14. A fan-type grinding wheel according to claim 13, wherein the leading longitudinal edge (12) forms an angle $\alpha$ with a radius (24) of the support plate (1), with a point of intersection (25) being disposed on the peripheral rim of the support plate (1), to which angle $\alpha$ applies: $+19° \geqq \alpha \geqq -13°$, the angle $\alpha$ being positive if the leading longitudinal edge (12) is arranged in a leading manner relative to the direction of rotation (11) and negative if the leading longitudinal edge (12) is arranged in a trailing manner.

15. A fan-type grinding wheel according to claim 13, wherein the peripheral working face (20) has an approximately semicircular cross-section.

16. A fan-type grinding wheel according to claim 13, wherein at least the first working face (8) is substantially plane.

* * * * *